US006399864B1

(12) United States Patent
Willcutt

(10) Patent No.: US 6,399,864 B1
(45) Date of Patent: Jun. 4, 2002

(54) TAMBOURINE

(76) Inventor: Mark A. Willcutt, 750 Willow Rd., Fulton, MS (US) 38843

( * ) Notice: Subject to any disclaimer, the term of this patent is extended or adjusted under 35 U.S.C. 154(b) by 0 days.

(21) Appl. No.: 09/815,704

(22) Filed: Mar. 23, 2001

(51) Int. Cl.[7] ..... G10D 13/02
(52) U.S. Cl. ..... 84/418; 84/419; 84/420; 84/422.3
(58) Field of Search ..... 84/418, 411 R, 84/421, 419, 420, 422.3

(56) References Cited

U.S. PATENT DOCUMENTS

| | | | | | |
|---|---|---|---|---|---|
| 3,481,239 | A | * | 12/1969 | Blumenfeld | 84/418 |
| 3,626,801 | A | * | 12/1971 | Moore | 84/411 R |
| 3,635,120 | A | * | 1/1972 | Koishikawa | 84/418 |
| 3,657,465 | A | | 4/1972 | Koishikawa | |
| 3,675,528 | A | | 7/1972 | Brick | |
| 3,779,126 | A | | 12/1973 | Hoey | |
| 4,269,105 | A | | 5/1981 | Salmon | |
| D268,419 | S | * | 3/1983 | Taninbaum | D17/22 |
| 4,858,510 | A | | 8/1989 | Shimoda et al. | |
| D336,488 | S | | 6/1993 | Grey | |
| 5,962,798 | A | * | 10/1999 | Meinl | 84/418 |
| 6,127,614 | A | * | 10/2000 | Lombardi | 84/418 |
| D446,238 | S | * | 8/2001 | Grey | D17/22 |

FOREIGN PATENT DOCUMENTS

| | | | |
|---|---|---|---|
| JP | 408185158 | * | 7/1996 |

* cited by examiner

*Primary Examiner*—Shih-Yung Hsieh

(57) ABSTRACT

A tambourine includes a frame that has a peripheral wall defining an interior space. The peripheral wall has a first edge and a second edge, each being adapted to be struck by a user. A plurality of apertures extends through the peripheral wall of the frame between an exterior face and an interior face of the peripheral wall. Each of the apertures has at least one sounding disc coupled in the respective aperture for making a sound when the peripheral wall of the frame is struck. The first edge of the peripheral wall of the frame has a plurality of protrusions that upwardly extend from the first edge. The protrusions are adapted for being raked across by the user such that the protrusions are for vibrating the sound disc in each of the apertures whereby the sound disc in each of the apertures produces a distinct sound.

5 Claims, 5 Drawing Sheets

TAMBOURINE

BACKGROUND OF THE INVENTION

1. Field of the Invention

The present invention relates to tambourines and more particularly pertains to a new tambourine for placing a ridged edge onto a tambourine instead of the traditional flat edge. This allows a user to produce a variety of sounds and effects.

2. Description of the Prior Art

The use of tambourines is known in the prior art. More specifically, tambourines heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,269,105; 3,779,126; 4,858,510; 3,657,465; 3,675,528; and U.S. Pat. No. Des. 336,588.

While these devices fulfill their respective, particular objectives and requirements, the aforementioned patents do not disclose a new tambourine. The inventive device includes a frame that has a peripheral wall such that the peripheral wall defines an interior space. The peripheral wall has a first edge and a second edge such that the first edge and the second edge are adapted to be struck by a user. A plurality of apertures extends through the peripheral wall of the frame between an exterior face and an interior face of the peripheral wall. Each of the apertures has at least one sounding disc coupled in the respective aperture such that the sounding disc is for making a sound when the peripheral wall of the frame is struck by the user. The first edge of the peripheral wall of the frame has a plurality of protrusions that upwardly extend from the first edge. The protrusions are adapted for being raked across by the user such that the protrusions are for vibrating the sound disc in each of the apertures whereby the sound disc in each of the apertures produces a distinct sound.

In these respects, the tambourine according to the present invention substantially departs from the conventional concepts and designs of the prior art, and in so doing provides an apparatus primarily developed for the purpose of placing a ridged edge onto a tambourine instead of the traditional flat edge. This allows a user to produce a variety of sounds and effects.

SUMMARY OF THE INVENTION

In view of the foregoing disadvantages inherent in the known types of tambourines now present in the prior art, the present invention provides a new tambourine construction wherein the same can be utilized for placing a ridged edge onto a tambourine instead of the traditional flat edge. This allows a user to produce a variety of sounds and effects.

The general purpose of the present invention, which will be described subsequently in greater detail, is to provide a new tambourine apparatus and method which has many of the advantages of the tambourines mentioned heretofore and many novel features that result in a new tambourine which is not anticipated, rendered obvious, suggested, or even implied by any of the prior art tambourines, either alone or in any combination thereof.

To attain this, the present invention generally comprises a frame that has a peripheral wall such that the peripheral wall defines an interior space. The peripheral wall has a first edge and a second edge such that the first edge and the second edge are adapted to be struck by a user. A plurality of apertures extends through the peripheral wall of the frame between an exterior face and an interior face of the peripheral wall. Each of the apertures has at least one sounding disc coupled in the respective aperture such that the sounding disc is for making a sound when the peripheral wall of the frame is struck by the user. The first edge of the peripheral wall of the frame has a plurality of protrusions that upwardly extend from the first edge. The protrusions are adapted for being raked across by the user such that the protrusions are for vibrating the sound disc in each of the apertures whereby the sound disc in each of the apertures produces a distinct sound.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tambourine apparatus and method which has many of the advantages of the tambourines mentioned heretofore and many novel features that result in a new tambourine which is not anticipated, rendered obvious, suggested, or even implied by any of the prior art tambourines, either alone or in any combination thereof.

It is another object of the present invention to provide a new tambourine, which may be easily and efficiently manufactured and marketed.

It is a further object of the present invention to provide a new tambourine, which is of a durable and reliable construction.

An even further object of the present invention is to provide a new tambourine which is susceptible of a low cost of manufacture with regard to both materials and labor, and which accordingly is then susceptible of low prices of sale to the consuming public, thereby making such tambourine economically available to the buying public.

Still yet another object of the present invention is to provide a new tambourine which provides in the apparatuses and methods of the prior art some of the advantages thereof, while simultaneously overcoming some of the disadvantages normally associated therewith.

Still another object of the present invention is to provide a new tambourine for placing a ridged edge onto a tambourine instead of the traditional flat edge. This allows a user to produce a variety of sounds and effects.

Yet another object of the present invention is to provide a new tambourine which includes a frame that has a peripheral wall such that the peripheral wall defines an interior space. The peripheral wall has a first edge and a second edge such that the first edge and the second edge are adapted to be struck by a user. A plurality of apertures extends through the peripheral wall of the frame between an exterior face and an interior face of the peripheral wall. Each of the apertures has at least one sounding disc coupled in the respective aperture such that the sounding disc is for making a sound when the peripheral wall of the frame is struck by the user. The first edge of the peripheral wall of the frame has a plurality of protrusions that upwardly extend from the first edge. The protrusions are adapted for being raked across by the user such that the protrusions are for vibrating the sound disc in each of the apertures whereby the sound disc in each of the apertures produces a distinct sound.

Still yet another object of the present invention is to provide a new tambourine that with its special modified edge the present invention would allow the user to easily simulate the sound of a "rake" or thumb roll.

Even still another object of the present invention is to provide a new tambourine that a user could produce sounds easily and properly every time, without using difficult or inconsistent techniques.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
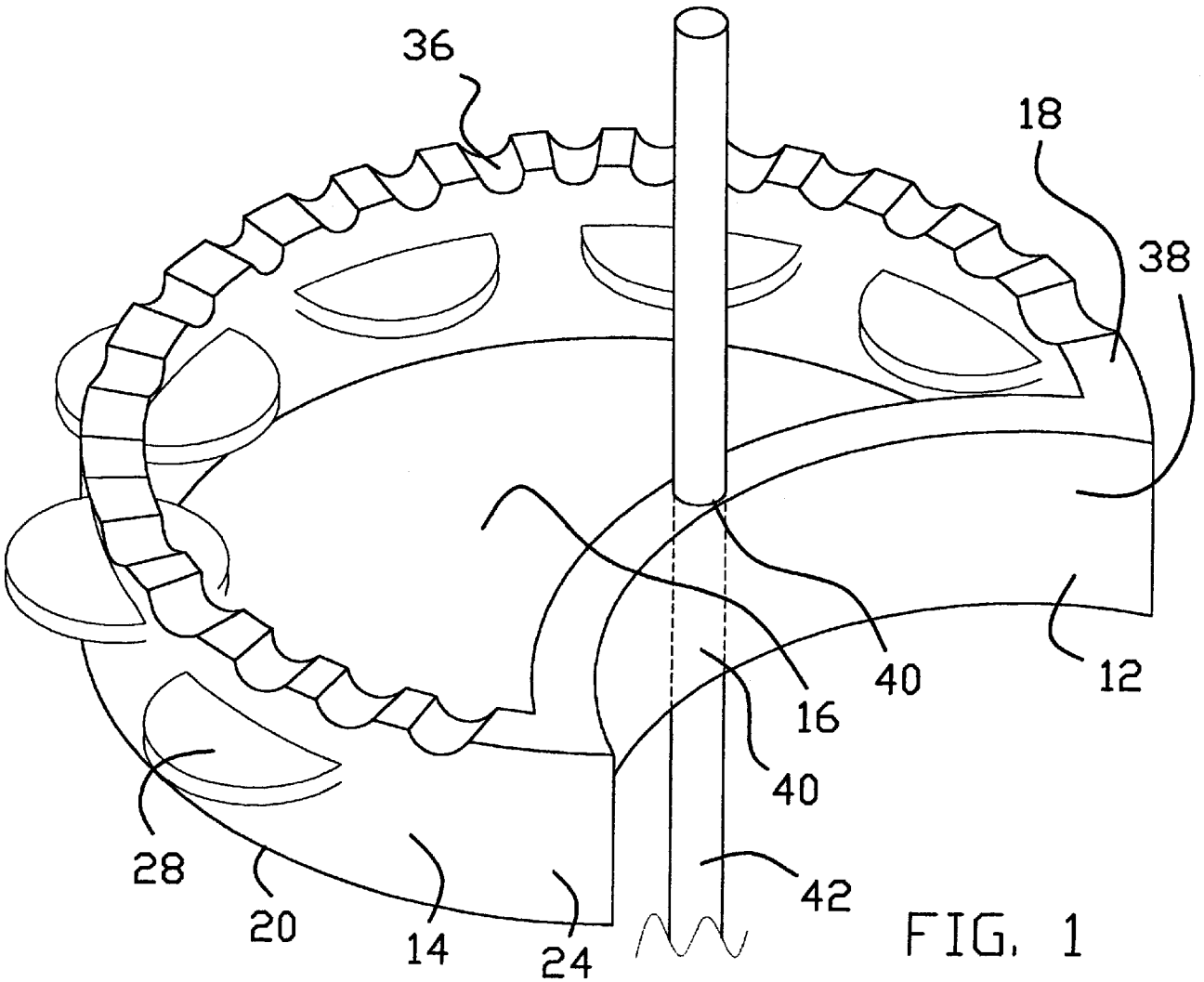
FIG. 1 is a perspective view of a new tambourine according to the present invention.
Figure 2:
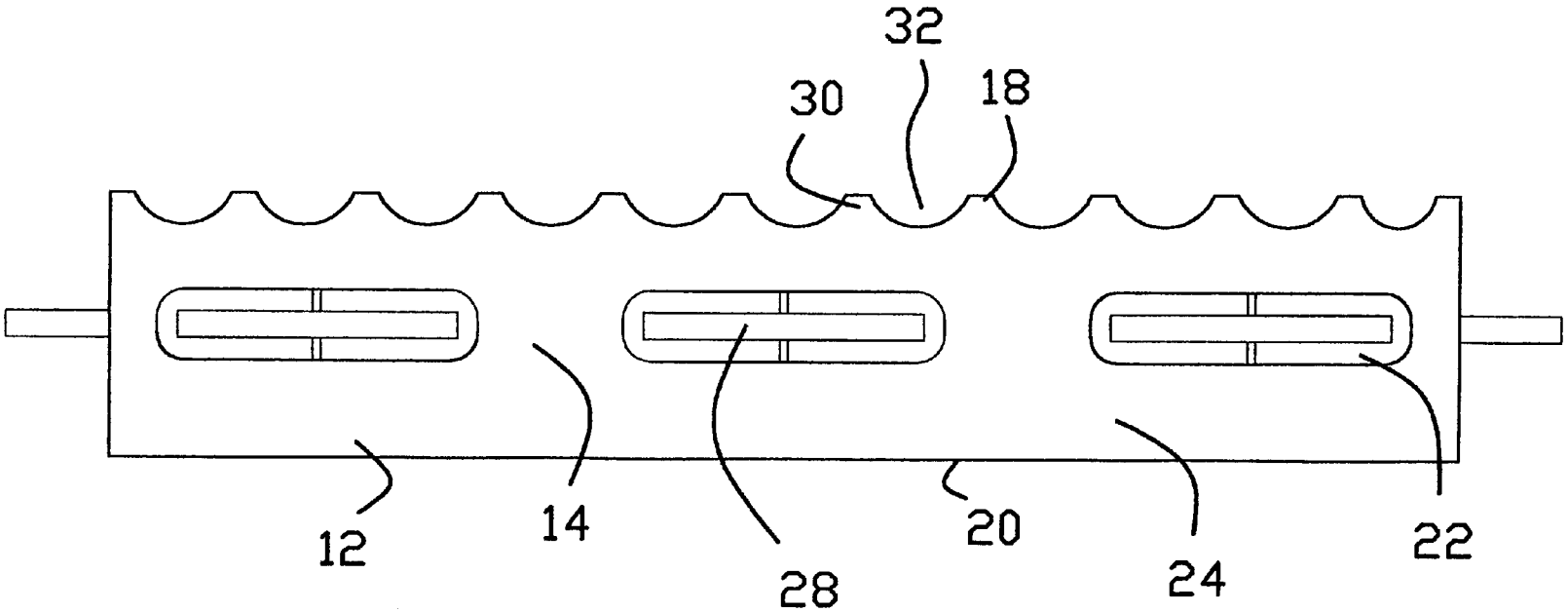
FIG. 2 is a side view of the present invention.
Figure 3:
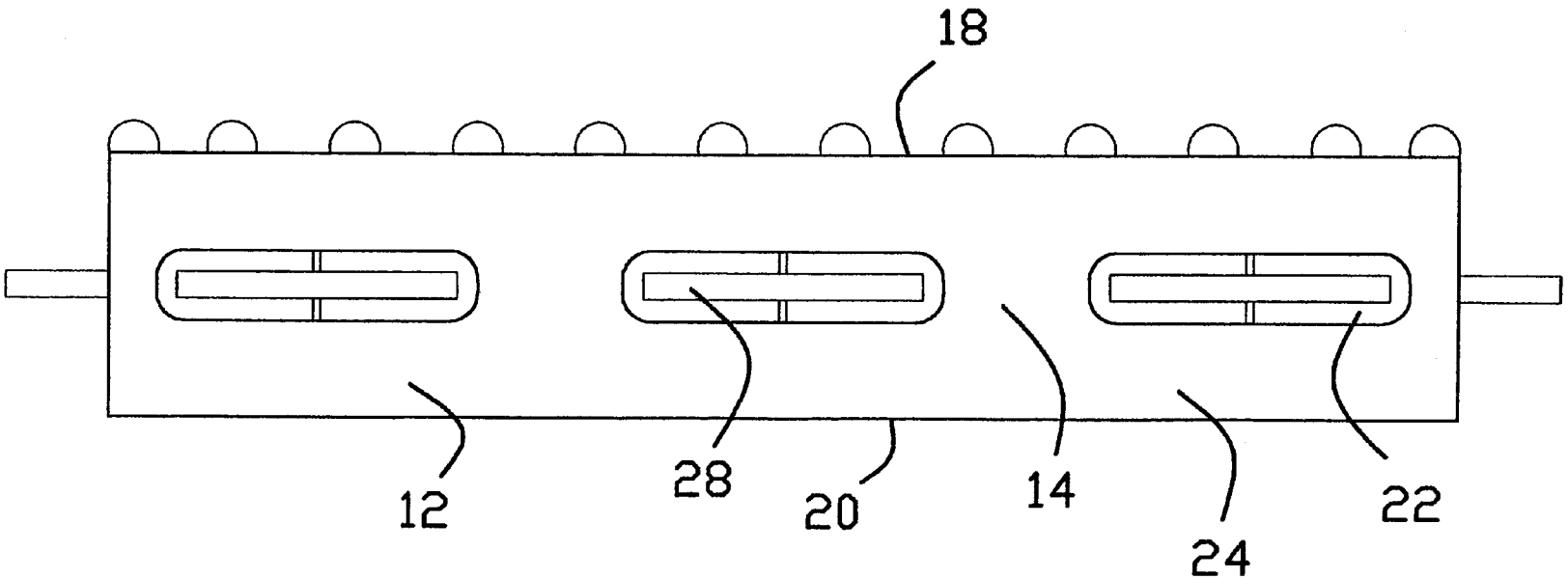
FIG. 3 is a side view of the present invention.
Figure 4:
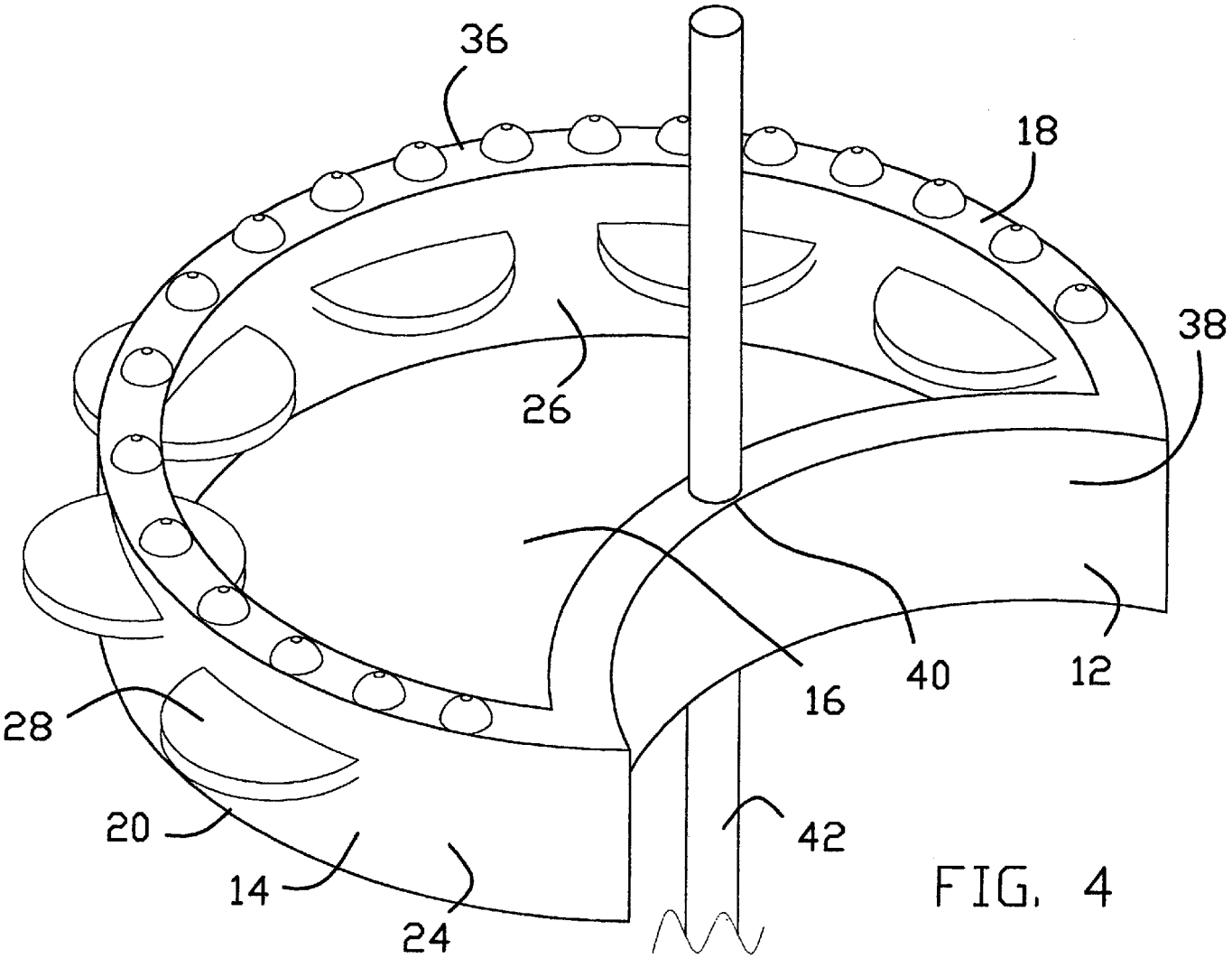
FIG. 4 is a perspective view of the present invention.
Figure 5:
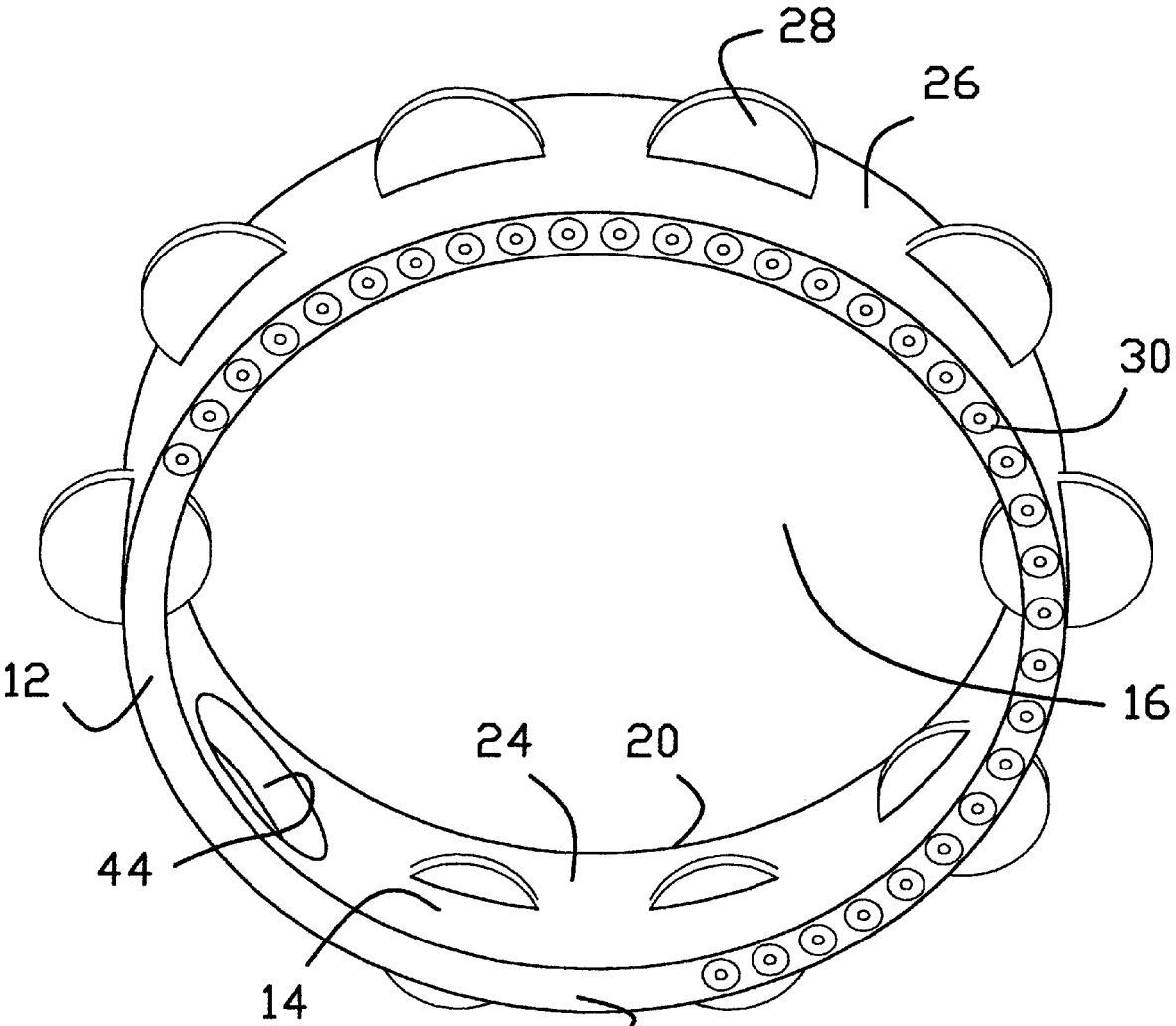
FIG. 5 is a perspective view of the present invention.

With reference now to the drawings, and in particular to FIGS. 1 through 5 thereof, a new tambourine embodying the principles and concepts of the present invention and generally designated by the reference numeral 10 will be described.

As best illustrated in FIGS. 1 through 5, the tambourine 10 generally includes a frame 12 that has a peripheral wall 14 such that the peripheral wall 14 defines an interior space 16. The peripheral wall 14 has a first edge 18 and a second edge 20 such that the first edge 18 and the second edge 20 are adapted to be struck by a user. A plurality of apertures 22 extends through the peripheral wall 14 of the frame 12 between an exterior face 24 and an interior face 26 of the peripheral wall 14. Each of the apertures 22 has at least one sounding disc 28 coupled in the respective aperture 22 such that the sounding disc 28 is for making a sound when the peripheral wall 14 of the frame 12 is struck by the user. The first edge 18 of the peripheral wall 14 of the frame 12 has a plurality of protrusions 30 that upwardly extend from the first edge 18. The protrusions 30 are adapted for being raked across by the user such that the protrusions 30 are for vibrating the sound disc 28 in each of the apertures 22 whereby the sound disc 28 in each of the apertures 22 produces a distinct sound.

Each of the protrusions 30 is substantially hemi-spherical such that each of the protrusions 30 is adapted for being struck by the user in sequence to vibrate the sounding disc 28 of each of the apertures 22. A plurality of arcuate cutouts 32 is defined by a pair of the protrusions 30 such that the arcuate cutouts 32 and the protrusions 30 for a substantially wave appearance along the peripheral wall 14. The arcuate cutouts 32 are adapted for is struck by the user in sequence to vibrate the sounding disc 28 of each of the apertures 22.

The peripheral wall 14 has a first arcuate portion 36 and second arcuate portion 38. The second arcuate portion 38 extends between a pair of ends of the first arcuate portion 36. The ends of the first arcuate portion 36 are lying in a plane such that the first arcuate portion 36 and the second arcuate portion 38 are concave with respect the plane of the ends of the first arcuate portion 36.

The second arcuate portion 38 has a bore 40 that extends through the second arcuate portion 38 such that the bore 40 is adapted for receiving a portion of a cymbal stand 42 whereby the frame 12 is mounted to the cymbal stand 42. The peripheral wall 14 of the frame 12 has a handle aperture 44 through the peripheral wall 14 such that the handle aperture 44 is adapted for receiving a hand of the user whereby the frame 12 can be held in the hand of the user.

In use, a user would simply hold the product normally in one hand and run a finger or thumb from the other hand along the wave-like surface. This would provide the roll sound without having to drag the thumb across the head of the tambourine and would allow the user to perform the roll even if the tambourine had no head. For a drum set mountable version, the wavy surface could simply be incorporated into the plastic guard or the rim of the tambourine. The user would produce the roll sound by dragging a stick across the special wavy surface.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tambourine comprising:

a frame having a peripheral wall such that said peripheral wall defines an interior space, said peripheral wall having a first edge and a second edge such that said first edge and said second edge are adapted for being struck by a user;

a plurality of apertures extending through said peripheral wall of said frame between an exterior face and an interior face of said peripheral wall, each of said apertures having at least one sounding disc coupled in said respective aperture such that said sounding disc is for making a sound when said peripheral wall of said frame is struck by the user;

said first edge of said peripheral wall of said frame having a plurality of protrusions upwardly extending from said first edge, said protrusions being adapted for being raked across by the user such that said protrusions are for vibrating said sound disc in each of said apertures whereby said sound disc in each of said apertures produces a distinct sound;

said peripheral wall having a first arcuate portion and second arcuate portion such that said second arcuate portion extends between a pair of ends of said first arcuate portion, said ends of said first arcuate portion defining a line extending between said ends of said first arcuate portion such that said first arcuate portion and said second arcuate portion are concave with respect said line defined by said ends of said first arcuate portion; and said second arcuate portion having a bore extending through said second arcuate portion such that said bore is adapted for receiving a portion of a cymbal stand whereby said frame is mounted to the cymbal stand.

2. The tambourine as set forth in claim 1, wherein each of said protrusions is substantially hemi-spherical such that each of said protrusions are adapted for being struck by the user in sequence to vibrate said sounding disc of each of said apertures.

3. The tambourine as set forth in claim 1, further comprising:

a plurality of arcuate cutouts being defined by a pair of said protrusions such that said arcuate cutouts and said protrusions for a substantially wave appearance along said peripheral wall whereby said arcuate cutouts are adapted for being struck by the user in sequence to vibrate said sounding disc of each of said apertures.

4. The tambourine as set forth in claim 1, wherein said peripheral wall of said frame has a handle aperture through said peripheral wall such that said handle aperture is adapted for receiving a hand of the user whereby said frame can be held in the hand of the user.

5. A tambourine comprising:

a frame having a peripheral wall such that said peripheral wall defines an interior space, said peripheral wall having a first edge and a second edge such that said first edge and said second edge are adapted for being struck by a user;

a plurality of apertures extending through said peripheral wall of said frame between an exterior face and an interior face of said peripheral wall, each of said apertures having at least one sounding disc coupled in said respective aperture such that said sounding disc is for making a sound when said peripheral wall of said frame is struck by the user; and said first edge of said peripheral wall of said frame having a plurality of protrusions upwardly extending from said first edge, said protrusions being adapted for being raked across by the user such that said protrusions are for vibrating said sound disc in each of said apertures whereby said sound disc in each of said apertures produces a distinct sound;

wherein each of said protrusions is substantially hemi-spherical such that each of said protrusions are adapted for being struck by the user in sequence to vibrate said sounding disc of each of said apertures;

wherein a plurality of arcuate cutouts being defined by a pair of said protrusions such that said arcuate cutouts and said protrusions for a substantially wave appearance along said peripheral wall whereby said arcuate cutouts are adapted for being struck by the user in sequence to vibrate said sounding disc of each of said apertures;

wherein said peripheral wall has a first arcuate portion and second arcuate portion such that said second arcuate portion extends between a pair of ends of said first arcuate portion, said ends of said first arcuate portion defining a line extending between said ends of said first arcuate portion such that said first arcuate portion and said second arcuate portion are concave with respect said line defined by said ends of said first arcuate portion;

wherein said second arcuate portion has a bore extending through said second arcuate portion such that said bore is adapted for receiving a portion of a cymbal stand whereby said frame is mounted to the cymbal stand;

wherein said peripheral wall of said frame has a handle aperture through said peripheral wall such that said handle aperture is adapted for receiving a hand of the user whereby said frame can be held in the hand of the user.

* * * * *